US006283036B1

(12) United States Patent
Munsinger

(10) Patent No.: US 6,283,036 B1
(45) Date of Patent: Sep. 4, 2001

(54) VARIABLE OUTPUT WARHEAD

(75) Inventor: Terrence Lane Munsinger, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/531,406

(22) Filed: Mar. 20, 2000

(51) Int. Cl.[7] ..... F42C 11/00; F42C 13/10; F42B 12/22

(52) U.S. Cl. ..... 102/479; 102/475; 102/476; 102/479; 102/491; 102/478; 102/492

(58) Field of Search ..... 102/478, 479, 102/475, 476, 491, 492, 308, 275.3, 275.8, 201

(56) References Cited

U.S. PATENT DOCUMENTS

| | | | | |
|---|---|---|---|---|
| H1214 | * | 8/1993 | Liva et al. | 102/201 |
| 2,941,615 | * | 6/1960 | Holmes | 102/476 |
| 3,812,783 | * | 5/1974 | Yang et al. | 102/201 |
| 3,977,330 | * | 8/1976 | Held | 102/479 |
| 4,391,195 | * | 7/1983 | Shann | 102/201 |
| 4,662,281 | * | 5/1987 | Wilhelm et al. | 102/494 |
| 5,158,173 | * | 10/1992 | Halsey et al. | 206/3 |
| 5,229,542 | * | 7/1993 | Bryan et al. | 102/491 |
| 5,698,814 | * | 12/1997 | Parsons et al. | 102/478 |
| 5,939,663 | * | 8/1999 | Walters et al. | 102/476 |

* cited by examiner

*Primary Examiner*—Charles T. Jordan
*Assistant Examiner*—Lulit Semunegus
(74) *Attorney, Agent, or Firm*—Anthony J. Serventi

(57) ABSTRACT

This invention involves a hard target penetrating warhead designed to produce a variable explosive discharge. A standard warhead casing is divided into several compartments with each compartment separated by a shock-absorbing shield. Explosive fill in contained within each compartment. The shock-absorbing shield inhibits the dynamic shock produced by detonating a compartment, thus preventing sympathetic detonation of adjoining compartments. As a result, the size of an explosive blast is controlled by detonating the explosive fill, in a set number of compartments. Each compartment also contains an igniter element, which initiates a slow burn of undetonated explosive fill.

10 Claims, 1 Drawing Sheet

VARIABLE OUTPUT WARHEAD

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

MICROFICHE APPENDIX

Not Applicable.

BACKGROUND OF THE INVENTION

1. Field of the Invention

This invention relates to warheads intended for destruction of targets using strategic precision. Specifically, this invention relates to missile warheads designed to control an explosive blast.

2. Description of the Related Technology

Missiles and warheads are used in a variety of demanding applications ranging from air to air and ground combat applications to structural demolition applications. Such applications often require missiles with warheads that can effectively and consistently penetrate and explode within hard targets with a great deal of accuracy.

A typical hard target missile includes an explosive warhead enclosed within a steel case. A fuze serves to ignite the explosive warhead following target impact. When a warhead penetrates a target, the fuze detonates a booster or explosive lead, which in turn detonates the explosive fill in the warhead. The explosive fill may be comprised of many different chemical compositions, depending upon the desired effect of the warhead. The amount or type of explosive placed in the warhead controls the intensity of the explosion. As a result, generally, the intensity of the explosion is set when the warhead is constructed.

Detonators contained within the housing of a fuze contain a primary explosive. Primary explosives in the fuze, are kept out-of-line with the secondary explosives until a predescribed series of events occurs which allows the fuze to progress to the "ARMED" condition. The fuze initiates the detonator cord leading to a secondary explosive in the explosive fill. Examples of secondary explosives are boosters and explosive leads.

As warfare becomes more focused on isolating and destroying specific targets, while limiting the damage to any adjacent area, the need for weaponry arises that enables the military to eliminate targets with a great precision. Ideally, the military seeks to limit casualties in the civilian population, as well as, damage to non-military targets such as schools, hospitals and places of worship. To ensure this type of surgical precision, the size of any explosion must be controlled to some extent.

Hence, a need exists in the art for a safe and cost effective warhead, which possesses the capability to create an explosion with varying degrees of intensity, while limiting the possibility that unused explosive fill will undergo sympathetic detonation.

Sympathetic detonation is an explosive chain reaction that occurs when one device or round (often referred to as a "donor explosion") initiates a shock wave that results in the high-order detonation throughout adjacent explosives. Sympathetic detonation has been addressed in related technology. One method of mitigating the effect of the dynamic shock which causes sympathetic detonation uses ground or crushed compressible pumice as described in U.S. Pat. No. 5,158,173 issued Oct. 27, 1992 to Halsey, et al. and assigned to The United States of America as represented by the Secretary of the Navy. U.S. Pat. No. 5,158,173 discloses a material for absorbing the dynamic shock of an explosion to prevent sympathetic detonation of adjacent explosives. The material comprises a filler material for damping an explosive shock. The filler means is collapsible and capable of absorbing an explosive shock and is also nonflammable in an aggressive thermal environment. A binding means allows the filler to cast into a self-supporting shape. A relatively compressible volcanic material, that is, a pumice is provided with a binder of a casting plaster.

SUMMARY OF THE INVENTION

The variable output warhead of the present invention addresses the need in the art. The current invention was devised to provide a warhead or missile that may be set at varying degrees of explosive intensity to minimize damage to the area adjacent to an intended target.

In the invention, a standard warhead casing is divided into compartments, which contain explosive fill. A shock-absorbing shield is located between each compartment to mitigate the dynamic shock of an explosion that may cause sympathetic detonation. An explosive lead is located in each compartment and a separate shielded detonation cord runs from the fuze to each explosive lead. In an alternative embodiment, an igniter is located in each compartment. The igniter is intended to eliminate the danger of the undetonated explosive fill by initiating deflagration, low-order burn.

One object of the present invention is to create a warhead that can be set to varying degrees to control the size of an explosion.

Another object of the invention is to create a warhead that can produce explosions of varying degrees, which allows a reduction of collateral damage to objects adjacent to the target.

A still further object of the invention is to create a warhead that minimizes the hazard of unexploded high explosive by inducing deflagration in unused explosives.

A still further object of the invention is to prevent sympathetic detonation of adjacent explosive fill within the warhead.

The invention addresses the need for a missile, which can be selected for desired explosive output. This allows "dialing in" (by pre-setting the fuze) the missile for a broader range of targets.

DETAILED DESCRIPTION OF THE INVENTION

Figure 1:
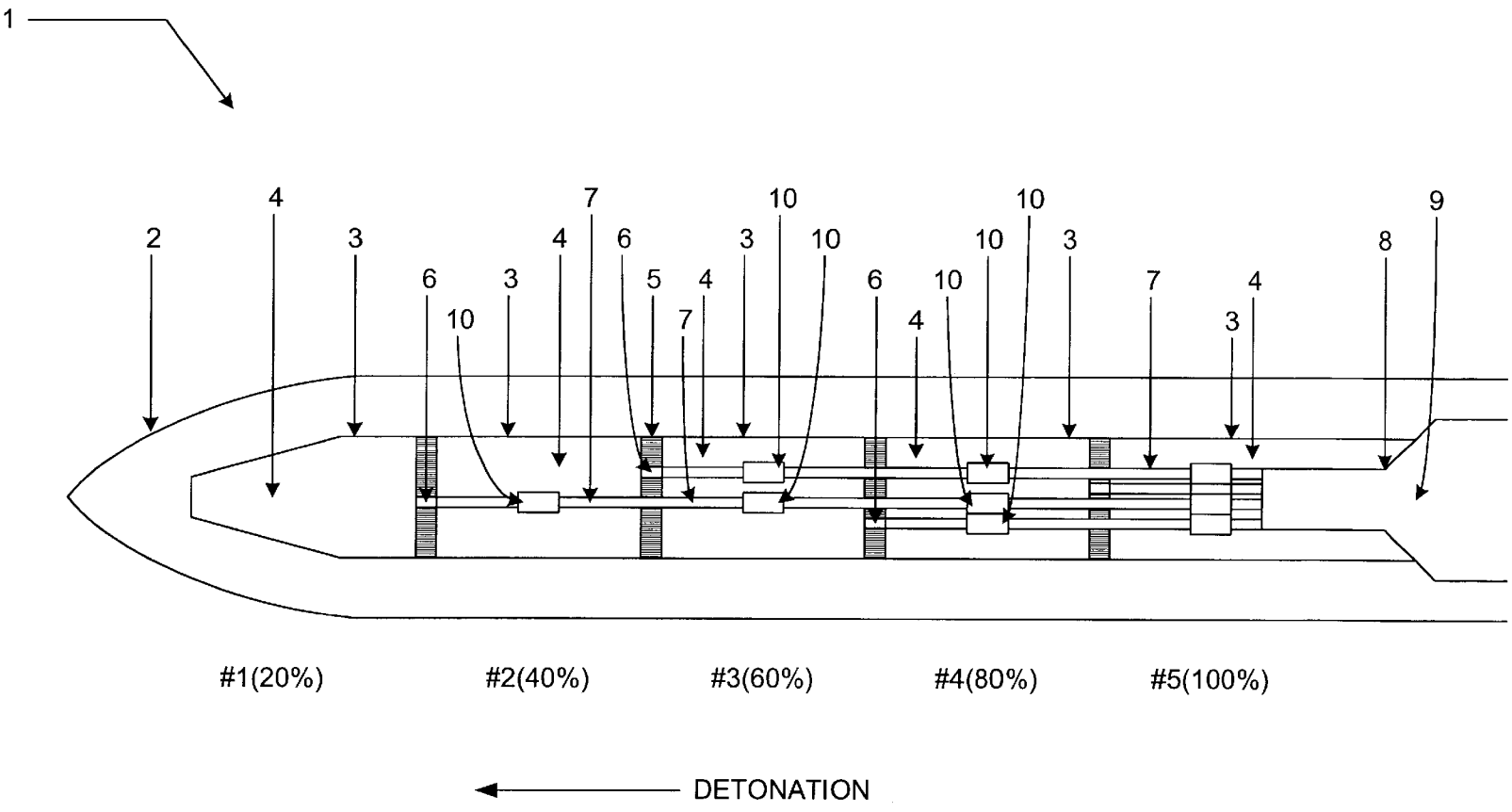
FIG. 1 is a cross-sectional diagram of a warhead in accordance with the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Referring more specifically to the drawing, for illustrative purposes the present invention is embodied in the apparatus as shown in FIG. 1. The warhead 1 includes a casing 2 divided into compartments 3 and a fuzewell 8 at one end. Explosive fill 4 is located within each compartment 3. A shock-absorbing shield 5 is located between each compartment 3. An explosive lead 6 is located in each compartment 3. Each explosive lead 6 acts as the terminal end of a shielded detonation cord 7, which originates at the fuzewell 8.

The invention is initiated by a fuze 9 in the fuzewell 8. The fuze 9 is selected for an explosive output from 0 to 100%. When the fuze 9 is initiated, it activates one or more lengths of shielded detonator cord 7. The selected detonator cords in turn initiate pyrotechnic igniter elements 10 embedded in the explosive fill 4 of each compartment 3 until the detonation reaches the end of the shielded detonator cord 7 where it initiates an explosive lead 6 booster charge and in turn the explosive fill 4. A shock-absorbing shield 5 is used between each compartment 3 prevent sympathetic detonation of an adjacent compartment. The pyrotechnic igniter elements 10 insure that the unselected explosive fill 4 reacts with less than a high order detonation. Common examples of explosive fill are CH6 and PBXN-7.

In the preferred embodiment, the shock absorbing shield 5 is constructed of ground or crushed compressible pumice as described in U.S. Pat. No. 5,158,173 issued Oct. 27, 1992 to Halsey, et al. and assigned to The United States of America as represented by the Secretary of the Navy. U.S. Pat. No. 5,158,173 is incorporated herein by reference.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A warhead which comprises:

a casing;

a plurality of compartments contained within said casing;

an explosive fill contained within each of said compartments;

means for absorbing dynamic shock positioned between adjacent compartments within said casing;

a detonator contained within each of said plurality of compartments;

a fuzewell means attached to said casing; and a plurality shielded detonation cords, each of said plurality of shielded detonation cords having a first end originating in said fuzewell and a second end of one of said plurality of shielded detonation cords terminating in each of said detonators.

2. The warhead of claim 1, wherein said explosive fill is selected from the group consisting of CH6 and PBXN-7.

3. The warhead of claim 1, wherein an igniter is contained within each of said plurality of compartments.

4. The warhead of claim 3, wherein said igniter is a pyrotechnic igniter element.

5. The warhead of claim 1, wherein said means for absorbing dynamic shock is a pumice shield, said pumice shield constructed of ground or crushed compressible pumice.

6. A warhead which comprises:

a casing;

a plurality of compartment means for containing explosives;

a shock-absorbing shield positioned between adjacent compartments within said casing, so that unwanted sympathetic detonation is hindered;

a detonator disposed within each of said plurality of compartments;

a fuzewell means attached to said casing; and a plurality shielded detonation cords, each of said plurality of shielded detonation cords having a first end originating in said fuzewell and a second end of one of said plurality of shielded detonation cords terminating in each of said detonators.

7. The warhead of claim 5, wherein said shock-absorbing shield constructed of ground or crushed compressible pumice.

8. The warhead of claim 5, wherein said explosive fill is selected from the group consisting of CH6 or PBXN-7.

9. The warhead of claim 5, wherein an igniter is disposed within each of said plurality of compartments.

10. The warhead of claim 9, wherein said igniter is a pyrotechnic igniter element.

* * * * *